United States Patent [19]

Massie et al.

[11] Patent Number: 4,679,928

[45] Date of Patent: Jul. 14, 1987

[54] DEVELOPMENT APPARATUS

[75] Inventors: Mark A. Massie, Glendora; Christopher C. Rhodes, Claremont, both of Calif.

[73] Assignee: Xerox Corporation, Stamford, Conn.

[21] Appl. No.: 744,442

[22] Filed: Jun. 13, 1985

[51] Int. Cl.[4] ..... G03G 15/09

[52] U.S. Cl. ..... 355/3 DD; 118/658

[58] Field of Search ..... 355/3 DD, 3 R; 118/657, 118/658

[56] References Cited

U.S. PATENT DOCUMENTS

| | | | |
|---|---|---|---|
| 3,301,152 | 1/1967 | Mayo et al. | 355/3 DD |
| 3,435,276 | 7/1969 | Anderson | 118/637 |
| 3,849,161 | 11/1974 | Klaenhammer | 117/17.5 |
| 3,872,826 | 3/1975 | Hanson | 118/8 |
| 3,900,001 | 8/1975 | Fraser et al. | 118/658 |
| 4,040,387 | 8/1977 | Washio et al. | 118/658 |
| 4,235,549 | 11/1980 | Eisbein et al. | 355/3 |
| 4,236,485 | 12/1980 | Inukai et al. | 118/690 |
| 4,286,543 | 9/1981 | Ohnuma et al. | 118/657 |

*Primary Examiner*—R. L. Moses

*Attorney, Agent, or Firm*—H. Fleischer; J. E. Beck; R. Zibelli

[57] ABSTRACT

An apparatus in which an electrostatic latent image recorded on a moving photoconductive member is developed. The apparatus includes a developer roller having the exterior surface thereof substantially smooth for transporting developer material into contact with the photoconductive member in the development zone. The developer roller moves at a greater velocity than the photoconductive member. In this way, a portion of the developer material moves at substantially the same velocity as the photoconductive member and another portion of the developer material moves at substantially the same velocity as the developer roller. This induces shearing of the developer material. The developer material moving at a velocity less than the velocity of the developer roller is collected in the region of the entrance to the development zone resulting in an extension of the development zone.

14 Claims, 3 Drawing Figures

DEVELOPMENT APPARATUS

This invention relates generally to a electrophotographic printing machine, and more particularly concerns an improved development system utilized therein.

Generally, an electrophotographic printing machine includes a photoconductive member which is charged to a substantially uniform potential so as to sensitize the surface thereof. The charged portion of the photoconductive surface is exposed to a light image of an original document being reproduced. This records an electrostatic latent image on the photoconductive member corresponding to the informational areas contained within the original document. After the electrostatic latent image is recorded on the photoconductive member, the latent image is developed by bringing a developer mix into contact therewith. This forms a powder image on the photoconductive member which is subsequently transferred to a copy sheet. Finally, the copy sheet is heated to permanently affix the powder image thereto in image configuration. Typical developer mixes employed in the art are well known and generally include dyed or colored thermoplastic powders, known as toner particles, which are mixed with coarser granules, such as ferromagnetic granules. The toner particles and carrier granules are selected such that the toner particles acquire the appropriate charge relative to the electrostatic latent image recorded on the photoconductive surface. When the developer mix is brought into contact with the charged photoconductive surface, the greater attractive force of the electrostatic latent image causes the toner particles to transfer from the carrier granules thereto.

With the advent of multi-color electrophotographic printing, a plurality of discretely colored toner particles are utilized. Each of the toner particles is arranged to produce a color complimentary in color to that of the original document. It is necessary to segregate the toner particles so that there is no intermingling of differently colored toner particles. This is achieved by dedicating various developing units to different colors. Thus, each developer unit employed in the electrophotographic printing machine develops the latent image with a particular color. The latent image recorded on the photoconductive surface corresponds to a single color light image of the original document. The developer unit develops a single color light image with toner particles complimentary in color thereto. After all of the electrostatic latent images have been developed with their respectively colored toner particles and transferred to the copy sheet in superimposed registration with one another, the resultant toner powder image is fused to the copy sheet forming a multi-color copy thereon. A magnetic brush development system is usually employed to develop the electrostatic latent images. One type of magnetic brush system has a highly agitated development zone wherein the photoconductive belt is wrapped about the developer roller with the development zone being substantially free of magnetic fields. This forms an extended development zone.

Hereinbefore, the copy exhibited various development defects. For example, the copy had lead/trail edge defects, solid area non-uniformity, banding due to the developer roller run out, high spacial frequency banding associated with other mechanical vibrations, and solid area graininess. The developer roller previously used had the exterior circumferential surface thereof roughened. This was generally achieved by flame spraying the exterior surface. It has been found that by removing the flame sprayed coating and employed a smoother surface, development significantly improved.

Various approaches have been devised for reproducing color copies and improving development in electrophotographic printing machines. The following disclosures appear to be relevant:

U.S. Pat. No.: 3,455,276
Patentee: Anderson
Issued: July 15, 1969

U.S. Pat. No.: 3,849,161
Patentee: Klaenhammer
Issued: Nov. 19, 1974

U.S. Pat. No.: 3,872,826
Patentee: Hanson
Issued: Mar. 25, 1975

U.S. Pat. No.: 4,040,387
Patentee: Washio et al.
Issued: Aug. 9, 1977

U.S. Pat. No.: 4,235,549
Patentee: Eisbein et al.
Issued: Nov. 25, 1980

U.S. Pat. No.: 4,236,485
Patentee: Inukai et al.
Issued: Dec. 2, 1980

The relevant portions of the foregoing patents may be briefly summarized as follows:

Anderson discloses a developing assembly having an applying roll assembly. The applying roll assembly has a plurality of magnetic members mounted on a shaft. A non-magnetic cylinderical sleeve is mounted rotatably on the shaft. The sleeve has a smooth outer surface. A doctor blade regulates the amount of powder advanced into the development nip area.

Klaenhammer describes a magnetic toner power applicator having a sleeve mounted rotatably. The outer layer of the roller sleeve is made from a smooth, electrically insulating material having an outer adhesive surface. The roller sleeve may rotate from 2 to 6 times the surface velocity of the drum having the master source document and transfer sheet in contact therewith.

Hanson discloses a multi-color electrophotographic printing machine employing a plurality of development units. Each development unit contains a differently colored toner material and is adapted to be actuated to develop a single color light image. The toner particles are complimentary in color to the single color light image. Each developer unit has a brush located at the upper end of the housing to provide a seal. The brush seal is located prior to the entrance to the development zone.

Washio et al. describes a magnetic brush member having a stationary magnet disposed in a non-magnetic development sleeve. The surface of the development sleeve may be smooth.

Eisbein et al. discloses a magnetic brush roller sleeve made from an electrically conductive material with a smooth peripherial surface.

Inukai et al. discloses a magnetic brush roller having a rotary sleeve with the surface thereof flat and smooth.

In accordance with the features of the present invention, there is provided an apparatus for developing an electrostatic latent image recorded on a moving photoconductive member in a development zone. The apparatus includes means, having the exterior surface thereof substantially smooth, for transporting developer material into contact with the photoconductive member in the development zone. The transporting means moves at a greater velocity than the photoconductive member with a portion of the developer material moving at substantially same velocity as the photoconductive member. Another portion of the developer material moves at substantially the same velocity as the transporting means so that shearing of the developer material occurs. Means are provided for collecting the developer material moving at a velocity less than the velocity of the transporting means in the region of the entrance to the development zone resulting in an extension of the development zone.

Pursuant to another aspect of the present invention, there is provided an electrophotographic printing machine of the type having a plurality of electrostatic latent images recorded successively on a moving photoconductive member. A plurality of developer units are arranged to develop each of the electrostatic latent images with a different color developer material with each developer unit being substantially identical. Each developer unit includes means, having the exterior surface thereof substantially smooth for transporting developer material into contact with the photoconductive member in the development zone. The transporting means moves at a velocity greater than the photoconductive member velocity with a portion of the developer material moving at substantially the same velocity as the photoconductive member. Another portion of the developer material moves at substantially the same velocity as the transporting means so that shearing of the developer occurs. Means are provided for collecting the developer material moving at a velocity less than the velocity of the transporting means in the region of the entrance to the development zone resulting in an extension of the development zone.

Other aspects of the present invention will become apparent as the following description proceeds and upon reference to the drawings, in which.

While the present invention will hereinafter be described in conjunction with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
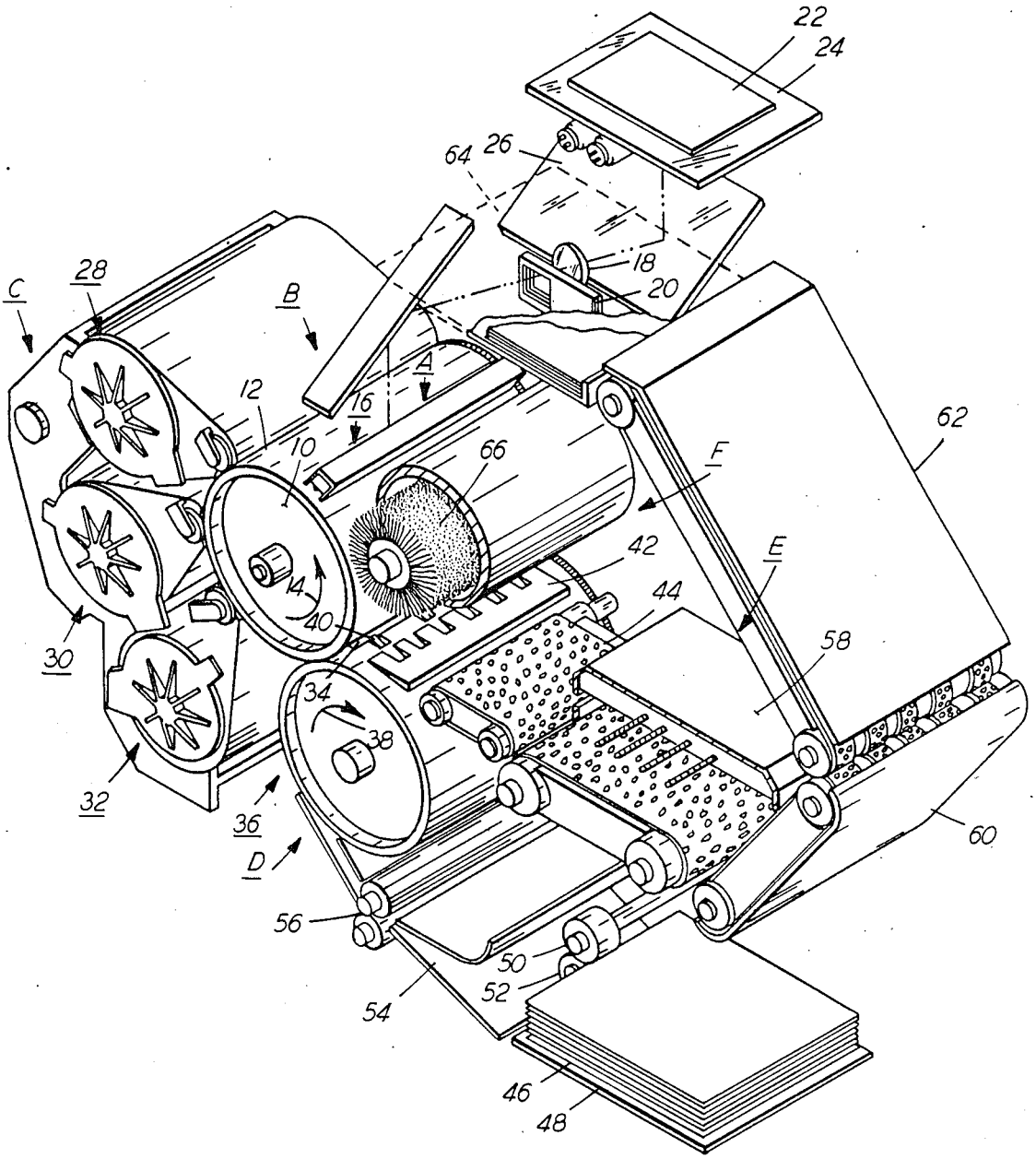
FIG. 1 is a schematic elevational view illustrating an electrophotographic printing machine incorporating the features of the present invention therein.

For a general understanding of the features of the present invention, reference is made to the drawings. In the drawings, like reference numerals have been used throughout to designate identical elements. FIG. 1 schematically depicts the various components of an illustrative electrophotographic printing machine incorporating the development system of the present invention therein. It will become evident from the following discussion that the development system described hereinafter is equally well suited for use in a wide variety of electrostatographic printing machines and is not necessarily limited in its application to the particular embodiment shown herein.

Inasmuch as the art of electrophotographic printing is well known, the various processing stations employed in the FIG. 1 printing machine will be shown hereinafter schematically and their operation described briefly with reference thereto.

As shown in FIG. 1, the multi-color electrophotographic printing machine employs a photoconductive member, such as a rotatably mounted drum 10 having a photoconductive surface 12 entrained about the circumferential surface thereof. Preferably, photoconductive surface 12 is formed from a material having a relatively panchromatic response to white light. By way of example, photoconductive surface 12 may be made from a selenium alloy deposited on a conductive substrate, such as aluminum. Drum 10 rotates in the direction of arrow 14 to pass through the various processing stations disposed thereabout.

Initially, photoconductive surface 12 passes through charging station A which has positioned thereat a corona generating device indicated generally by the reference numeral 16. Corona generating device 16 charges photoconductive surface 12 to a relatively high, substantially uniform potential.

Thereafter, the charged portion of photoconductive surface 12 is advanced through exposure station B. Exposure station B includes a moving lens system, generally designated by the reference numeral 18, and a color filter mechanism shown generally at 20. An original document 22 is stationarily supported upon a transparent viewing platen 24. This enables successive incremental areas of original document 22 to be illuminated by moving lamp assembly 26. Lamp assembly 26 and lens system 18, as well as filter mechanism 20, move in a timed relationship with drum 10 to scan successive incremental areas of original document 22 disposed upon platen 24. In this manner, a flowing light image of original document 22 is projected onto charged photoconductive surface 12. The charge on photoconductive surface 12 is selectively dissipated in accordance with the light intensity projected thereon. Filter mechanism 20 is adapted to interpose selected color filters into the optical light path. The appropriate color filter operates on the light rays passing through lens 18 to record an electrostatic latent image on photoconductive surface 12 corresponding to a pre-selected spectral region of the electromagnetic wave spectrum, hereinafter referred to as a single color electrostatic latent image.

After exposure, drum 10 rotates the single color electrostatic latent image recorded on photoconductive surface 12 to development station C. Development station C includes three developer units generally indicated by the reference numerals 28, 30, and 32, respectively. Developer units 28, 30, and 32 are all of the type generally referred to as magnetic brush developer units. In a magnetic brush developer unit, a magnetized developer mix having carrier granules and toner particles is continually brought through a directional flux field to form a brush of developer material. The developer mix is continually moving to provide fresh developer mix to the brush. Preferably, the brush in the magnetic brush system comprises a magnetic member with a mass of developer mix adhering thereto by magnetic attraction. The developer mix includes carrier granules having toner particles clinging thereto by triboelectric attraction. This chain-like arrangement of developer mix stimulates the fibers of a brush. Development is achieved by bringing the brush of developer mix into contact with photoconductive surface 12. Each of the developer units 28, 30 and 32, respectively, apply toner particles to photoconductive surface 12 which are adapted to absorb light within a pre-selected spectral region of the electromagnetic wave spectrum corresponding to the wavelength of light transmitted through filter 20. For example, an electrostatic latent image formed by passing the light image through a green filter will record the red and blue regions of the spectrum as areas of relatively high charge density on photoconductive surface 12, or the green light rays will pass through the filter and cause the charged density on photoconductive surface 12 to be reduced to a voltage level substantially ineffective for development. The charged areas are then made visible by applying green absorbing (magenta) toner particles to the electrostatic latent image recorded on photoconductive surface 12. Similarly, a blue separation is developed with blue absorbing (yellow) toner particles, while a red separation is developed with red absorbing (cyan) toner particles. The detailed structure of the developer units will be described hereinafter with reference to FIGS. 2 and 3.

After development, the now visible toner powder image is moved to transfer station D. At transfer station D, the toner powder image is transferred to a sheet of final support material 34, such as plain paper, amongst others, by means of a transfer drum, shown generally at 36. Transfer drum 36 rotates in the direction of arrow 38 and is adapted to have support material 34 secured releasably thereto so as to be recirculated therewith. The surface of transfer drum 36 is electrically biased to a potential having a sufficient magnitude and the proper polarity to electrostatically attract toner particles from photoconductive surface 12 to support sheet 34. Inasmuch as support material 34 is secured releasably on transfer drum 36, successive toner powder images may be transferred thereto in superimposed registration with one another as drum 36 rotates through successive cycles. After the last transfer operation, support sheet 34 is stripped from transfer drum 36. Gripper fingers 40 space support sheet 34 from drum 36 and stripper bar 42 is interposed therebetween. In this manner, support sheet 34 is separated from transfer drum 36. Thereafter, endless belt conveyor 44 advances support sheet 34 to fusing station E.

With continued reference to FIG. 1, a stack 46 of sheets 34 is disposed on tray 48. Feed roll 50, cooperating with the retard roll 52, advances successive uppermost sheets 34 from stack 46 into chute 54. Chute 54 guides the advancing sheet into the nip between register rolls 56. Register rolls 56 align the sheet and forward it, in registration with gripper fingers 40, to transfer drum 36. The sheet is secured to transfer drum 36 for recirculation therewith as hereinbefore described.

After the toner powder images have been transferred to support material 34, support material 34 is removed from drum 36 and advanced to fuser 58 which permanently affixes the transferred powder image thereto. After the fusing process, support material 34 is advanced by endless belt conveyer 60 and 62 to catch tray 64 for subsequent removal from the printing machine by the operator.

Although a preponderance of the toner particles are transferred to support material 34, invariably some residual toner particles remain on photoconductive surface 12. These residual toner particles are removed from photoconductive surface 12 as it moves through cleaning station E. The residual toner particles are initially brought under the influence of a cleaning corona generating device (not shown) which neutralizes the electrostatic charge remaining on photoconductive surface 12. The neutralized toner particles are then cleaned from photoconductive surface 12 by a rotatably mounted fiberous brush 66 in contact therewith.

It is believed that the foregoing description is sufficient for purposes of the present invention to illustrate the general operation of an electrophotographic printing machine embodying the teachings of the present invention therein.

Figure 2:
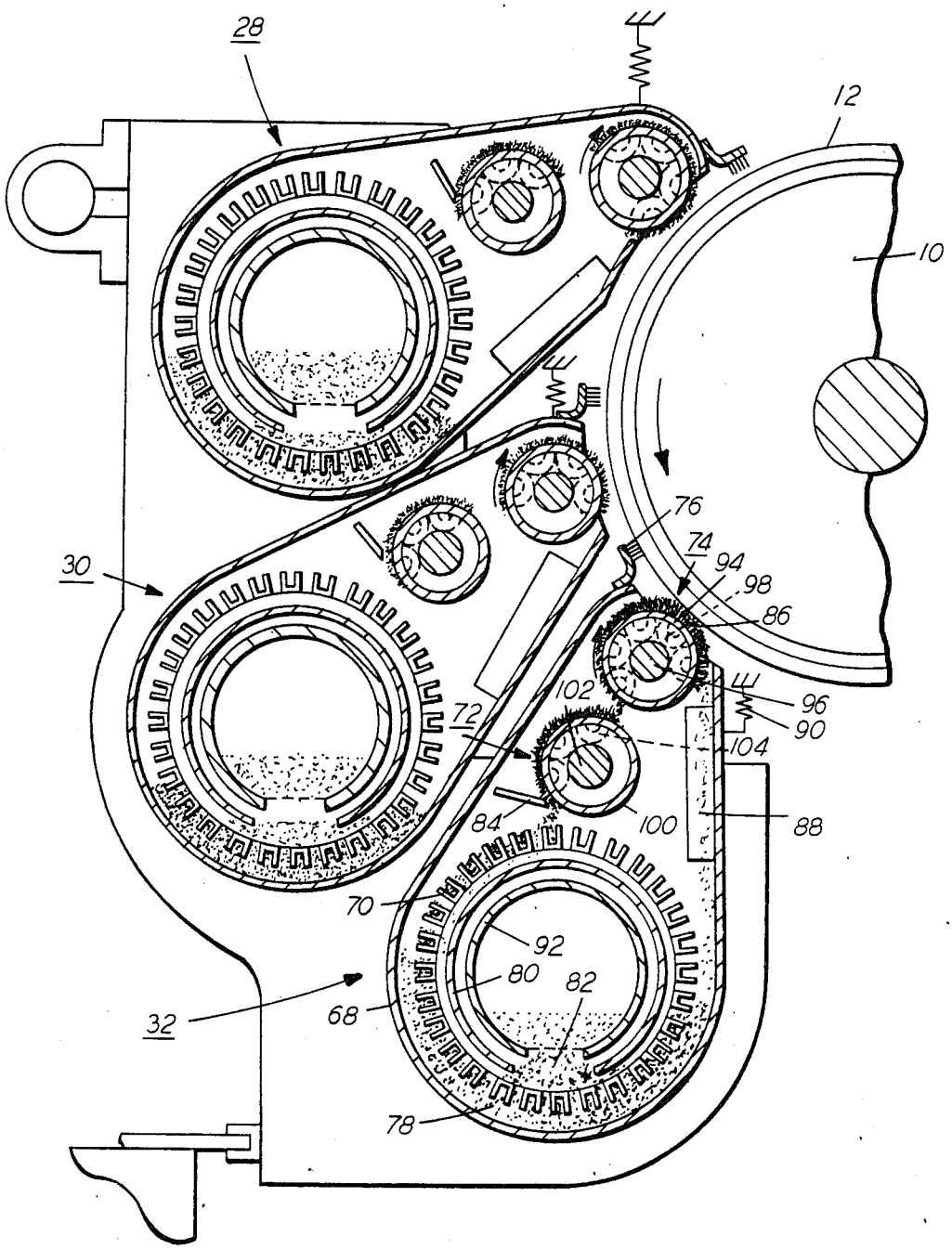
FIG. 2 is a sectional elevational view of the development system employed in the FIG. 1 printing machine.

Referring now to the specific subject matter of the present invention, FIG. 2 depicts schematically the multi-color development system incorporated in the FIG. 1 printing machine. Development units 28, 30, and 32 are depicted therein in an elevational, sectional view to indicate more clearly the various components included therein. Only developer unit 32 will be described, in detail, as developer units 28 and 30 are substantially identical thereto. The distinction between each developer unit is the color of the toner particles contained therein and minor geometical differences due to the mounting positions. Developer unit 28 may have yellow toner particles, unit 30 magenta toner particles, and unit 32 cyan toner particles, although different color combinations may be employed. For purposes of explanation, developer unit 32 will hereinafter be described in detail.

The primary components of developer unit 32 are a developer housing 68, a paddle wheel 70, a transport roll 72, a developer roll 74 and a developer housing seal 76. Paddle wheel 70 is a cylindrical member with buckets or scoops around the periphery thereof. The paddle wheel is adapted to rotate so as to elevate developer mix 78 from the lower regions of housing 68 to the upper regions thereof. When developer mix 78 reaches the upper regions of housing 68, it is lifted from the paddle wheel buckets to transport roll 72. Alternate buckets of paddle wheel 70 have apertures in the root diameter thereof so that the developer mix carried in these areas is not moved to transport roll 72, but in lieu thereof, returns to the lower region of developer housing 68. As developer mix 78 returns to the lower region of developer housing 68, it cascades over shroud 80 which is of tubular configuration with an aperture 82 in the lower region thereof. Developer mix 78 is recirculated in this manner so that the carrier granules are continually agitated to mix with fresh toner particles. This generates a strong triboelectric charge between the carrier granules and toner particles. As developer mix 78, in the paddle wheel buckets approaches transport roll 72, the magnetic field produced by the fixed magnets therein attract developer mix 78. Transport roll 72 moves developer mix 78 is an upperwardly direction. A surplus of developer mix 78 is furnished and metering blade 84 controls the amount of developer mix carried over transport roll 72 to developer roll 74 and into development zone 86 located between photoconductive surface 12 and developer roll 74. Seal 76 is a brush in contact with photoconductive surface of drum 10 so as to form a seal between developer unit 28 and the photoconductive surface 12. In this manner, the developer mix within developer unit 28 is prevented from escaping from housing 68. At the exit of development zones 86, the strong magnetic fields in a direction generally tangential to developer roll 74 continue to secure the unused developer mix and the carrier granules thereto. Upon passing from the development zone, the unused developer mix and denuded carrier granules enter a region relatively free from magnetic forces and fall from developer roll 74 in a downwardly direction into the lower region of developer housing 68. As the material descends, it passes through mixing baffle 88 which diverts the flow from the ends toward the center of developer housing 68 to provide mixing in this direction. After the toner powder image has been deposited and photoconductive surface 12, development action is discontinued and the developer mix removed from contact with photoconductive surface 12. This is necessary in order to insure that subsequent images, which are to be developed with diffently colored toner particles, are not affected by the prior toner particles. This is achieved by de-energizing paddle wheel 70, transport roll 72 and developer roll 74. This enables spring 90 to pivot developer housing 68 to the non-operative position in which developer roller 74 is spaced from photoconductive surface 12. Additional toner particles are dispensed from toner dispenser 92 through aperture 82 into the lower region of housing 68 to mix with the developer mix 78 thereat.

Developer roller 74 includes a non-magnetic tubular member preferably made from aluminum, having the exterior circumferential surface thereof substantially smooth. Tubular member 94 is journaled for rotation by suitable means, such as ball bearing mounts. A shaft 96, preferably made of steel, is concentrically mounted within tubular member 94 and serves as a fixed mounting for magnet 98. Similarly, transport roll 72 includes a non-magnetic tubular member preferably made from aluminum having an irregular or roughened exterior surface. Tubular member 100 is journaled for rotation by suitable means, such as ball bearing mounts. A shaft 102, preferably made of steel, is concentrically mounted within tubular member 100 and functions as a fixed mounting for magnet 104.

Figure 3:
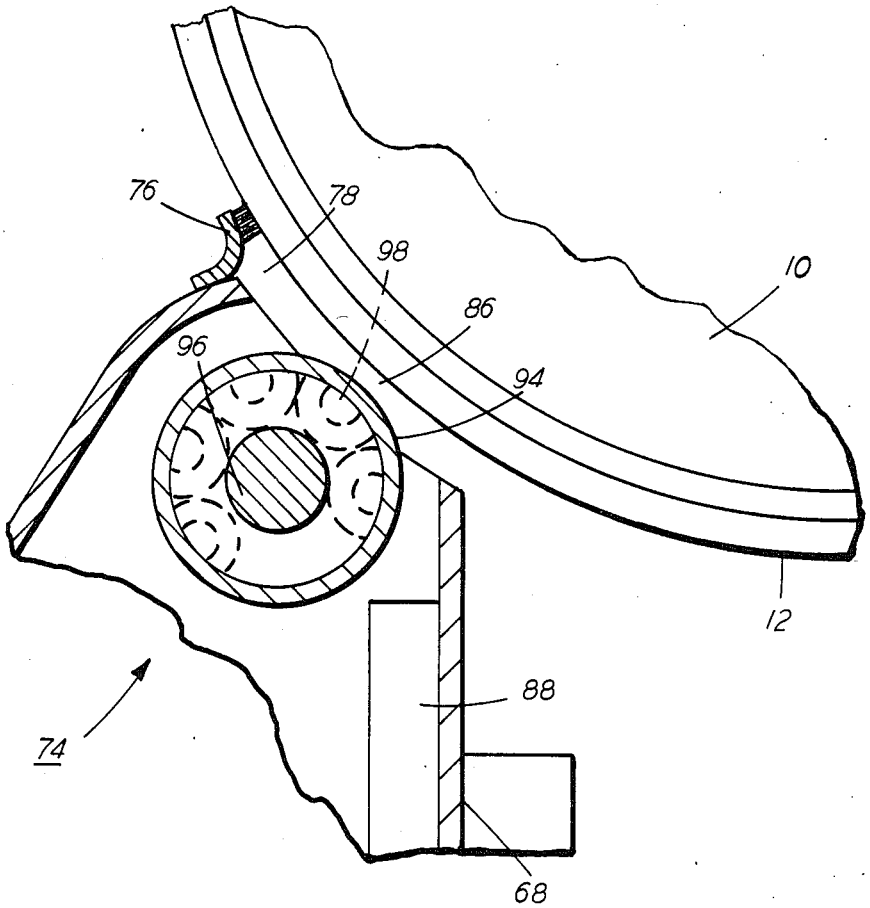
FIG. 3 is a fragmentary, sectional elevational view depicting the developer roller of one of the developer units shown in the FIG. 2 development system.

Turning now to FIG. 3, the development process will be described in greater detail. As shown thereat, as tubular member 94 rotates, developer mix 78 is advanced into development zone 86. Tubular member 94 rotates at an angular velocity such that the tangential velocity thereof, in development zone 86, is approximately 5 times the magnitude of the tangential velocity of photoconductive drum 10 in development zone 86. As the brush of developer mix contacts photoconductive surface 12 of drum 10, the developer mix is attracted to the electrostatic latent image recorded thereon. Thus, a portion of the developer mix moves at the tangential velocity of photoconductive drum 10 with another portion thereof moving at the tangential velocity of tubular member 94. This causes a dynamic shearing of the developer mix within the volume of developer mix in development zone 86. Inasmuch as high shearing forces are present, there is an increased triboelectrification of the toner particles within development zone 86. Preferably, the gap between metering blade 84 and tubular member 104 of transport roll 72 is set such that the compressed pile height of the developer mix on tubular member 94 of developer roll 74 is preferably about 0.040 inches (0.10 centimeters). The developer mix moving at a slower tangential velocity and not adhering to photoconductive surface 12 of drum 10 backs up to the entrance region of development zone 86. Brush seal 76 confines the developer material in developer housing 68 causing the developer material to collect on transport roller 72. The material appears to slide at a slow speed toward the entrance zone. The developer mix material is prevented from escaping from developer housing 68 by brush 76 which forms a seal. At that point, developer mix is collected. This results in an extension of the effective development zone.

It has been found that after developer roller 74 completes developing an electrostatic latent image recorded on photoconductive surface 12 of drum 10, the negative image thereof remains on the compressed developer mix. This clearly demonstrates that at least a portion of the developer mix is traveling at the tangential velocity of the photoconductive surface 12 of drum 10. The resulting developed images eliminate the once per revolution roller strobing, have smooth solid area development free of most predominate higher spacial frequency development defects, and lead/trial edge defects are greatly minamized.

In recapitulation, it is apparent that the development system of the present invention significantly improves development of electrostatic latent images by employing a smooth developer roller rotating at a significantly higher tangential velocity than the tangential velocity of the photoconductive drum in the development zone. Therefore, it is evident that there has been provided in accordance with this invention, an apparatus for developing an electrostatic latent image that fully satisfies the aims and advantages hereinbefore set forth. While this invention has been described in conjunction with a specific embodiment thereof, it is evident that many alternatives, modifications, and variations will be apparent to those skilled in the art. Accordingly, it intended to embrace all alternatives, modifications, and variations that fall within the spirit and broad scope of the appended claims.

We claim:

1. An apparatus for developing an electrostatic latent image recorded on a moving photoconductive member in a development zone, including:

means, having the exterior surface thereof substantially smooth, for moving developer material into contact with the photoconductive member in the development zone, said moving means moving at a greater velocity than the photoconductive member with a portion of the developer material moving at substantially the same velocity as the photoconductive member and another portion of the developer material moving at substantially the same velocity as said moving means so that shearing of the developer material occurs; and means for collecting the developer material moving at a velocity less than the velocity of said moving means in the region of the entrance to the development zone resulting in an extension of the development zone.

2. An apparatus according to claim 1, further including a housing defining a chamber having said transporting means and said collecting means disposed therein.

3. An apparatus according to claim 2, further including means for regulating the thickness of the layer of developer material on the exterior surface of said transporting means.

4. An apparatus according to claim 3, wherein said moving means includes:

a tubular member having the exterior circumferential surface thereof substantially smooth, said tubular member being mounted rotatably in the chamber of said housing; and a magnetic member mounted stationarily in the chamber of said housing and being disposed interiorly of and spaced from said tubular member.

5. An apparatus according to claim 4, wherein said collecting means includes means for sealing the gap between said housing and the moving photoconductive member in the region of the entrance to the development zone so that developer material cannot escape therefrom and accumulated in this region.

6. An apparatus according to claim 5, wherein said regulating means includes:

a roller arranged to advance developer material from the chamber of said housing to said tubular member; and a blade member having an edge thereof closely spaced from said roller to define a gap therebetween through which the developer material passes.

7. An apparatus according to claim 6, wherein the gap between the edge of said blade member and said roller is about 0.040 inches (0.10 centimeters).

8. An electrophotographic printing machine of the type having a plurality of electrostatic latent images recorded successively on a moving photoconductive member and a plurality of developer units arranged to develop each of the electrostatic latent images with a different color developer material with each developer unit being substantially identical and including:

means, having the exterior surface thereof substantially smooth, for moving developer material into contact with the photoconductive member in the development zone, said moving means moving at a greater velocity than the photoconductive member with a portion of the developer material moving at substantially the same velocity as the photoconductive member and another portion of the developer material moving at substantially the same velocity as said moving means so that shearing of the developer material occurs; and means for collecting the developer material moving at a velocity less than the velocity of said moving means in the region of the entrance to the development zone resulting in an extension of the development zone.

9. A printing machine according to claim 8, further including a housing defining a chamber having said transporting means and said collecting means disposed therein.

10. A printing machine according to claim 9, further including means for regulating the thickness of the layer of developer material on the exterior surface of said transporting means.

11. A printing machine according to claim 10, wherein said moving means includes:

a tubular member having the exterior circumferential surface thereof substantially smooth, said tubular member being mounted rotatably in the chamber of said housing; and a magnetic member mounted stationarily in the chamber of said housing and being disposed interiorly of and spaced from said tubular member.

12. A printing machine according to claim 11, wherein said collecting means includes means for sealing the gap between said housing and the moving photoconductive member in the region of the entrance to the development zone so that developer material cannot escape therefrom and accumulates in this region.

13. A printing machine according to claim 12, wherein said regulating means includes:

a roller arranged to advance developer material from the chamber of said housing to said tubular member; and a blade member having one edge thereof closely spaced from said roller to define a gap therebetween through which the developer material passes.

14. A printing machine according to claim 13, wherein the gap between the edge of said blade member and said roller is about 0.040 inches (0.10 centimeters).

* * * * *